US006422717B1

(12) United States Patent
Beadle

(10) Patent No.: US 6,422,717 B1
(45) **Date of Patent: *Jul. 23, 2002**

(54) LIGHTING FIXTURE WITH BEAM SPREAD ADJUSTMENT

(76) Inventor: Joshua Beadle, 5362 Caminito Vista Lujo, San Diego, CA (US) 92130

( * ) Notice: Subject to any disclaimer, the term of this patent is extended or adjusted under 35 U.S.C. 154(b) by 0 days.

This patent is subject to a terminal disclaimer.

(21) Appl. No.: 09/656,817

(22) Filed: Sep. 7, 2000

Related U.S. Application Data

(63) Continuation-in-part of application No. 09/537,061, filed on Mar. 28, 2000.

(51) Int. Cl.[7] ..... F21V 21/14
(52) U.S. Cl. ..... 362/285; 362/188; 362/187
(58) Field of Search ..... 362/267, 153.1, 362/410, 187, 353, 354, 355, 414, 431, 285

(56) References Cited

U.S. PATENT DOCUMENTS 4,987,523 A 1/1991 Lindabury
5,031,080 A * 7/1991 Aikens ..... 362/187
5,075,828 A 12/1991 Gordin
5,226,721 A * 7/1993 Stokes ..... 362/153.1
5,249,109 A 9/1993 Denison
5,386,354 A 1/1995 Osteen
5,459,649 A 10/1995 Ellison
5,718,506 A * 2/1998 Yeh ..... 362/344

* cited by examiner

*Primary Examiner*—Sandra O'Shea
*Assistant Examiner*—Hargobind S. Sawhney
(74) *Attorney, Agent, or Firm*—Eleanor M. Musick; Kilpatrick Stockton LLP

(57) ABSTRACT

The outdoor lighting comprises a stem, a socket disposed in the top of the stem for retaining a halogen lamp, a socket housing, a diffuser lens and a reflector top. The socket housing has a lower cylindrical portion having a first inner diameter for fitting over the outer diameter of the upper part of the stem, a second cylindrical portion having a second inner diameter larger than the first inner diameter adapted to closely fit over the outer diameter of the cylindrical diffuser lens. The lower cylindrical portion of the socket housing has a slot extending upward from its bottom edge with a width greater than a diameter of a locking screw that is screwed into a bore in the side of the stem. When the locking screw is loosened, rotation of the socket housing forces an edge of the slot against the locking screw, which converts the rotational motion of the socket housing into an axial motion, causing the socket housing, diffuser and reflector to be raised or lowered relative to the stem, and modifying the beam spread depending on the direction of movement.

18 Claims, 3 Drawing Sheets

LIGHTING FIXTURE WITH BEAM SPREAD ADJUSTMENT

RELATED APPLICATIONS

This is a continuation-in-part of application Ser. No. 09/537,061, filed Mar. 28, 2000.

FIELD OF THE INVENTION

This invention generally relates to an outdoor lighting fixture, and more specifically, to an outdoor lighting fixture with an adjustable focusable beam.

BACKGROUND OF THE INVENTION

Environmental lighting, particularly outdoor lighting, is well known in commercial or public settings, such as parks and schools. Such lighting has also become increasingly popular for use in private residences, both to enhance the appearance and safety of the outdoor area and for security by eliminating hiding places and unobserved entry points for intruders.

Pathlights in landscape and outdoor lighting systems are placed along walkways and stairs to provide illumination for the safety of persons walking on the path in the dark, and may be located in other areas where a broad wash of light is desired, such as in a planter. Typically, such lights will have a diffuser and/or reflector to prevents the light from shining directly upward into the pedestrian's eyes, and avoids the creation of shadow lines, both of which can make navigation of the darkened path even more difficult. Reflectors are used to spread and direct a wash of light down onto the pathway. Adjustment of the beam spread can be varied to minimize glare on uphill views and to maximize beam spread on level ground where glare is not an issue. However, the inclusion of such down-reflectors can limit the ability to adjust the beam spread without removing and/or replacing hardware in the fixture or subjecting the fixture to corrosion due as a compromise for making the fixture more readily adjustable.

It would be desirable to provide a pathlight that allows the amount of glare and/or beam width to be adjusted without introducing components that can result in premature failure of the fixtures as well as providing a lighting fixture that are easily maintained.

SUMMARY OF THE INVENTION

It is an advantage of the present invention to provide a compact lighting fixture which has a variable beam spread.

It is a further advantage of the present invention to provide a lighting fixture that permits adjustment of beam spread and re-lamping maintenance by loosening a single fastener.

Another advantage of the present invention is to provide a lighting fixture that is sealed against moisture intrusion and, thus, resists corrosion.

In an exemplary embodiment, the outdoor lighting comprises a stem, a socket assembly disposed in the top of the stem for retaining a halogen lamp, a socket housing, a diffuser and a reflector top. The socket housing has a lower cylindrical portion having a first inner diameter for fitting over the outer diameter of the upper part of the stem, a second cylindrical portion having a second inner diameter larger than the first inner diameter adapted to closely fit over the outer diameter of the cylindrical diffuser lens, and a flared portion joining the lower cylindrical portion to the upper cylindrical portion. The flared reflector fits over top of the diffuser lens and can be sealed, using silicone, epoxy or other sealant, to protect the internal surfaces of the lighting fixture from moisture intrusion. The lower cylindrical portion of the socket housing has a diagonal slot extending upward from its bottom edge with a width greater than a diameter of a locking screw that is screwed into a bore in the side of the stem to form a bayonet-like fastener. When the locking screw is loosened, rotation of the socket housing forces an edge of the diagonal slot against the locking screw, which converts the rotational motion of the socket housing into an axial motion, causing the socket housing, diffuser and reflector to be raised or lowered relative to the stem, and modifying the beam spread depending on the direction of movement. After the desired beam spread is achieved, the fastening screw can be tightened, locking the assembly in place. The same connection can be used to access the halogen lamp for replacement, thus permitting a single tool to be used for adjustment and maintenance of the fixture.

The socket assembly includes a base connector that has a first outer diameter that closely fits within the inner diameter of the stem, which is a hollow tube. A threaded bore in the side of the base connector is aligned with a bore through the side of the stem to receive the fastening screw. The base connector has a second inner diameter for receiving a commercially-available socket. The plastic socket is interference-fit within the second diameter of the base connector and has a first end into which the halogen lamp is plugged and a second end for attachment of conductive wires. Wires are inserted into the second end of the socket making connection with electrical contacts within the socket. The wires extend from the plastic socket, passing through the base connector and stem for connection to a voltage source. The small size of the plastic socket allows the fixture, and particularly the stem, to be quite small and compact, providing a significant range of possible sizes as may be desired for different applications.

For installation, the bottom end of the stem has a threaded connector for connection to a spike that can be inserted into the ground.

BRIEF DESCRIPTION OF THE DRAWINGS

For a more complete understanding of the present invention, reference is now made to the following detailed description of the embodiments illustrated in the accompanying drawings, wherein.

DETAILED DESCRIPTION OF PREFERRED EMBODIMENTS

Figure 1:
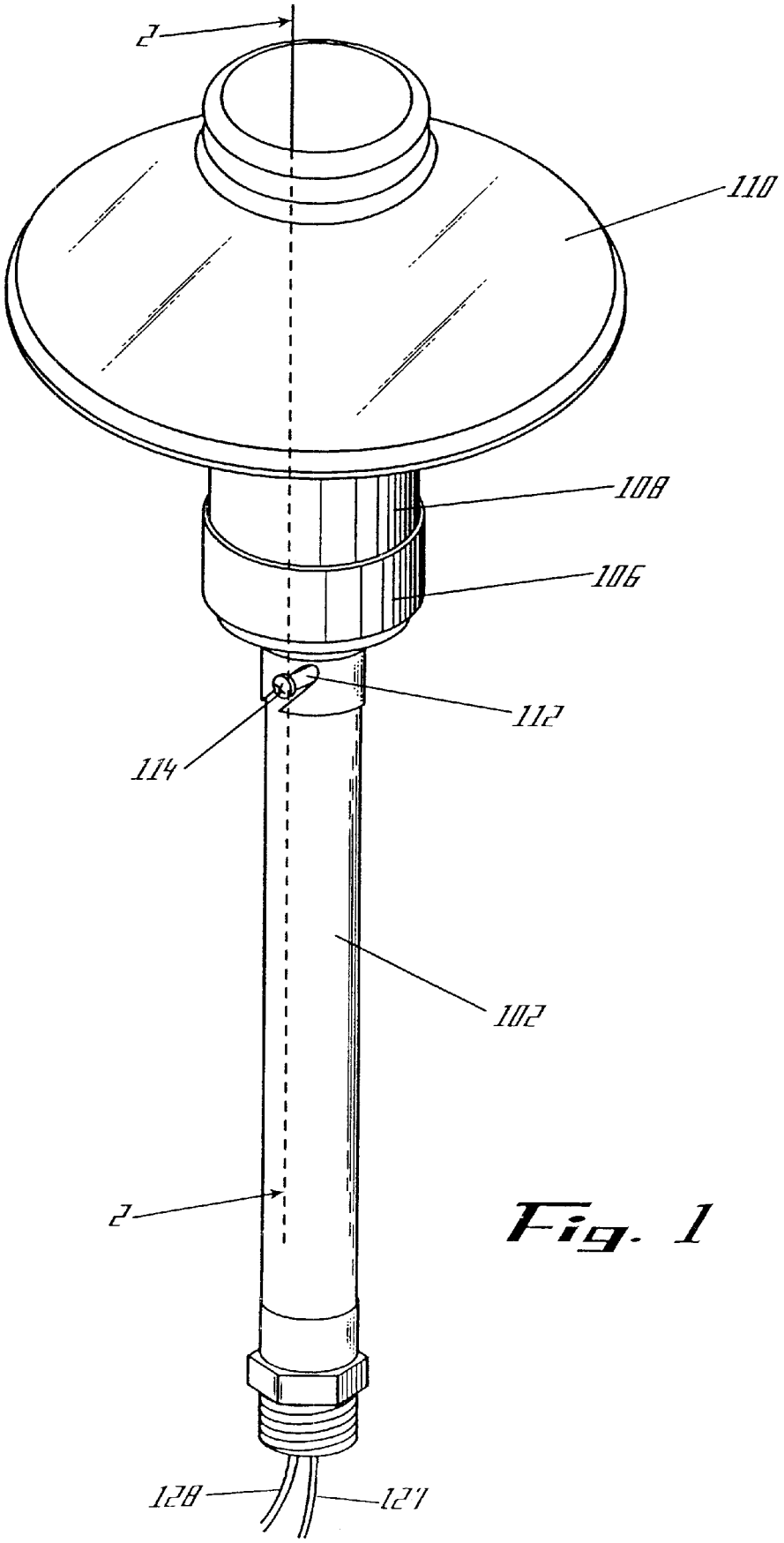
FIG. 1 is a perspective view of the lighting fixture.

FIG. 1 illustrates a lighting fixture having an adjustable beam focus generally designated by reference numeral 100. The lighting fixture 100 includes a stem in the form of a generally elongated tubular post 102 with a first end and a second end, the first end to which is attached to the lower end of the socket housing 106, a cylindrically-shaped lens 108 (not shown in FIG. 1) disposed in the upper end of socket housing 106, and a symmetrically flared reflector/reducer 110. Post 102, socket housing 106 and reducer/reflector 110 are preferably made of a durable and aesthetically pleasing material, such as copper. Other corrosion resistant materials may be used as well, including stainless steel, anodized aluminum, powder-coated or painted metal, or high temperature plastics or composites.

Figure 2:
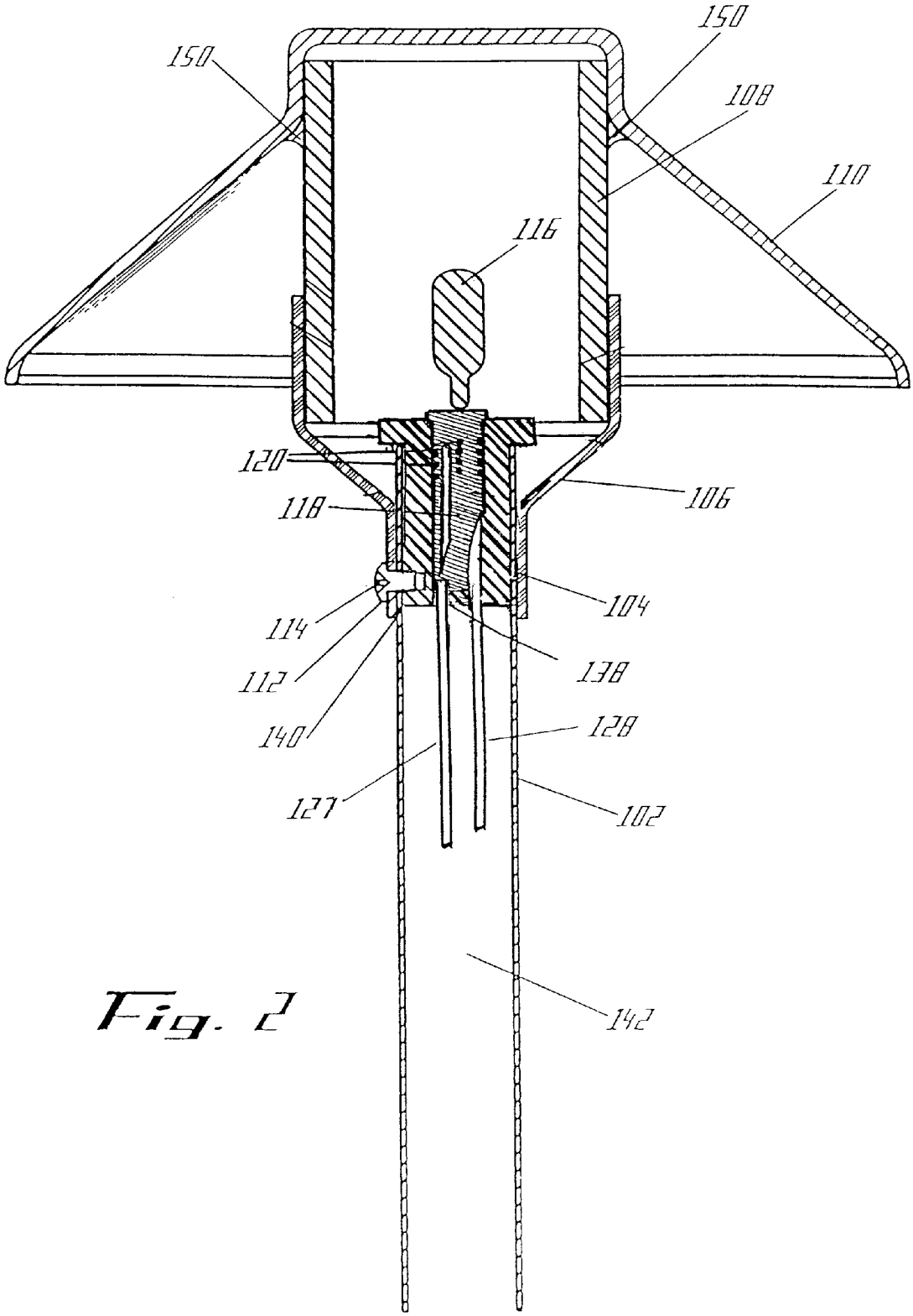
FIG. 2 is a cross-sectional view, taken along line 2—2 of FIG. 1.

The elements of lighting fixture 100 are shown in FIG. 2. Tubular post 102 has a first (upper) end, a second (lower) end, and a substantially hollow interior 142 through which electrical wires 127, 128 pass to provide connection to the voltage source. Base connector 104, which has a lamp end and a base end which closely fits within the first end of post 102, retains the electrical components, i.e., the lamp 116 and socket 120, of lighting fixture 100 in a fixed position relative to post 102. The lower end of socket housing 106, which encloses the first end of post 102 and base connector 104, has a first diameter adapted to be slidably mounted over the outside of the first end of post 102. The upper end of socket housing 106 has a second diameter larger than the first diameter, and a flared center section connects the lower and upper end. Alternatively, the upper and lower sections of socket housing 106 can be stepped, or other variations can be selected to alter the aesthetics of the fixture. The second end of base connector 104 has an outer diameter adapted to be interference-fit within the inner diameter of post 102. Diagonal slot 112, in cooperation with locking screw 114, converts rotation of socket housing 106 relative to post 102 into an axial motion, whereby socket housing 106, diffuser lens 108 and reflector/reducer 110 are raised or lowered relative to tube 102. In an alternate embodiment, the slot can be straight, running along a line parallel to the longitudinal axis of the fixture. In this embodiment, socket housing 106 can be moved relative to post 102 by loosening locking screw 114 and sliding socket housing 106 in the desired axial direction.

Locking screw 114 passes through bore 144 in post 102 and threadably engages threaded bore 140 of base connector 104 to create a robust fit between the screw and threaded bore. Fasteners other than a screws may be used, to provide all or a part of the function of screw 114. For example, the fastener can be a fixed pin or peg extending from the post and base connector to provide the function of guiding the slot 112 to raise and lower the reflector relative to the lamp, however, such a fixed pin will not allow the socket housing to be tightened down to prevent movement. In such an embodiment, it may be sufficient to ensure a close fit between the inner diameter of the socket housing and the outer diameter of the post such that friction, alone, may be sufficient to strongly resist movement unless a deliberate rotational force is applied. To provide another example, the fastener can be a spring-loaded button which releases and permits rotation or removal of the socket housing from the post only when the button is depressed. Other variations will be apparent to those of skill in the art.

In the preferred embodiment, locking screw 114 is a conventional slotted machine screw. Counter-clockwise rotation of screw 114 loosens the screw, releasing the tension exerted by the screw against socket housing 106. This release of tension allows socket housing 106 to be slidably rotated about the first end of post 102. rotation. Conversely, the clockwise rotation of screw 114 tightens the screw into threaded bore 140, locking socket housing 106 to post 102.

A cylindrical lens 108 surrounds halogen lamp 116 and has an outer diameter adapted to provide an interference fit within the upper cylinder of socket housing 106. Lens 108 can be transparent or translucent glass, plastic or like material, preferably impact resistant and capable of withstanding outside environmental conditions. In the preferred embodiment, lens 108 is a frosted, tempered glass to provide uniform diffusion and optimal tolerance of moisture, temperature and sunlight exposure. It may be desirable to use a silicone-based adhesive at the union of lens 108 and socket housing 106 to further provide a seal against moisture intrusion. Symmetrically flared reflector/reducer 110 is mounted concentrically atop lens 108 and fixed in place with the application of a silicone-based or similar adhesive 150 that can create a watertight seal. In the preferred embodiment, at least two applications of the adhesive are applied in order to seal the resulting compartment from infiltration by moisture that can accelerate corrosion of the internal components of the fixture. Due to the flexible nature of the adhesive, an ample application of adhesive can also act as a shock-absorber to reduce the possibility of lens breakage when the fixture is struck or jarred, and allows for factory-precise assembly of the lighting fixture to be maintained during field installation while still allowing access to the interior of the fixture.

Figure 3:
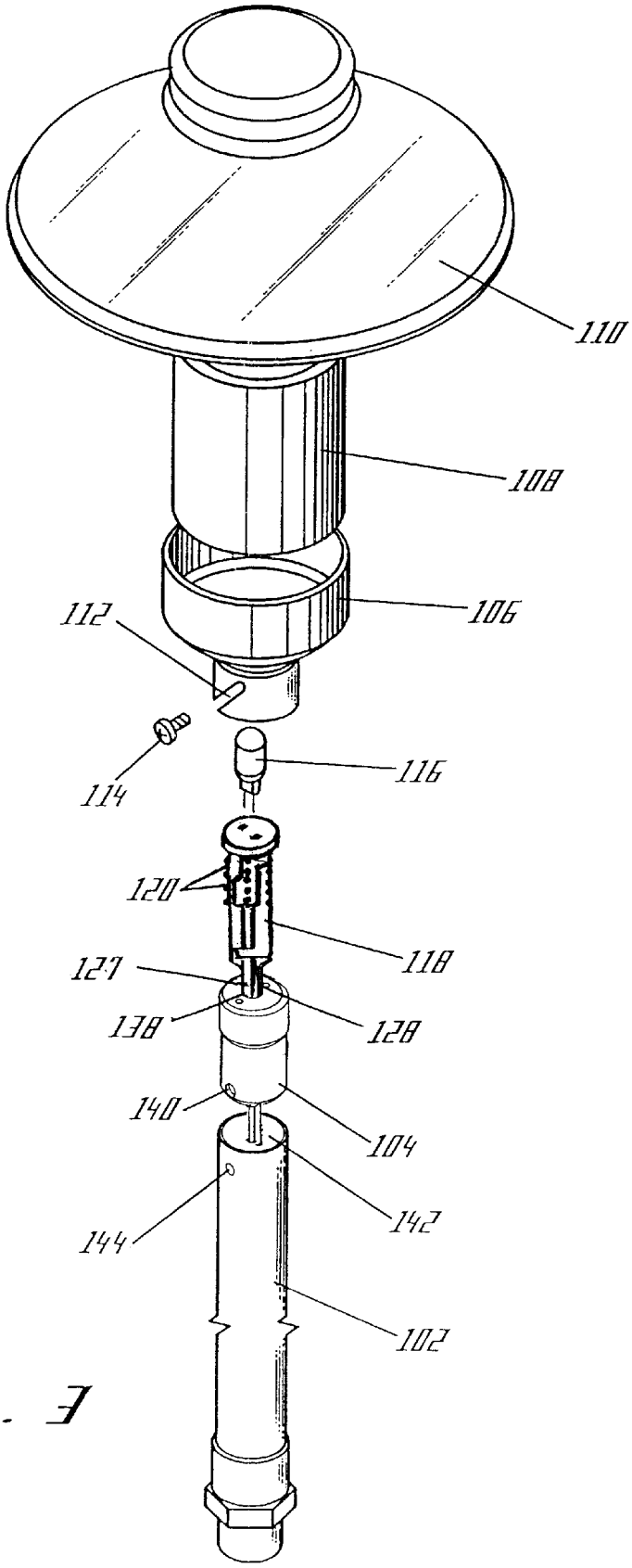
FIG. 3 is an exploded perspective view of the lighting fixture.

The individual components of fixture 100 can be readily seen in the exploded view of FIG. 3. As previously described, base connector 104 retains the electrical components of lighting fixture 100 at a fixed position relative to the first end of tubular post 102. The stem end of base connector 104 fits closely within the first end of post 102. A small ridge or other physical protrusion may be formed in the outer surface of base connector 104 to create an interference fit to provide resistance against axial separation of base connector 104 from post 102. Rotational movement is prevented by alignment of smooth bore 144 in post 102 and threaded bore 140 in base connector 104 and inserting screw 114 into the threaded bore of base connector 104.

A socket 118 having a first end and a second end is formed from a non-conductive body of plastic or other durable, non-conductive materials, with a pair of metal conductors passing through the body and configured to mate with the conductive prongs of a conventional lamp at the first end and to receive the ends of wires 127, 128 to the second end to conduct voltage from the source through post 102 to the lamp 116. Socket 118 is inserted through central opening 138 in base connector 104 where it is firmly held by an interference fit. To ensure the durable fit of socket 118 into base connector 104, the outer surface of the socket is configured with a series of small vertically aligned teeth 120 which enhance the grip of the outer surface of socket 118 and the inner surface of opening 138. The robust connection between the conductors within socket 118 and the ends of wires 127, 128 provides prevents the wires 127, 128 from being pulled away and disconnected from socket 118 when the fixture is being repositioned. In the preferred embodiment, socket 118 is commercially-available from BJB of Amsberg, Germany, as Part No. 25.114.1121.90, which is a lamp holder with a push fixing for a 7.8 mm cut out. Selection of other types of sockets of similar specifications will be apparent to those of skill in the art. The small diameter of socket 118 permits the selection of base connector 104 and post 102 with smaller diameters than could previously be used with multi-component sockets of the prior art, thus providing greater variability in the overall dimensions of the light fixture or components thereof.

Lamp 116 is preferably a halogen filament-type lamp but can also be tungsten filament, incandescent, or other comparable lamp commonly used in similar lighting applications. The voltage supply (not shown), which may be either a 12 V transformer or 120 VAC. In an exemplary embodiment (not shown), a molded plastic ground spike with female threads is attached to the threaded second end of tubular post 102 for securing the unit lighting fixture into the ground. In this embodiment, wiring 127, 128 exits the second end of post 102, is threaded through an opening in the ground spike, and then continues to termination at the power source.

The following procedure is followed to adjust the fixture to achieve a narrower, more focused beam of light: screw 114 is rotated in a counter-clockwise direction which loosens the tension exerted by the screw against the housing. This allows the user to rotate housing 106 in a counter-clockwise direction which in turn increases the vertical distance between reflector/reducer 110 and lamp 116. Slot 112, in cooperation with screw 114 converts the rotational motion to an axial motion. (In the alternate embodiment, axial force is applied to the fixture to provide the relative motion.) Once the desired focal length of the beam is achieved, the user simply rotates screw 114 in a clockwise direction to tighten it, thus preventing the housing from being freely rotatable around tubular post 102. Conversely, when the user desires a less focused, broader spread of light, for example, to reduce glare from fixtures located on uphill views, the relative distance between reflector/reducer 110 and lamp 114 must be decreased by rotating beam adjustment housing 106 in a clockwise direction (after first loosening screw 114) to shorten the focal length of the light beam. As with the counter-clockwise rotation of housing 106, clockwise rotation is converted into axial motion by the cooperation of diagonal slot 112 and screw 114.

The lighting fixture of the present invention provides a wide range of beam control, both quality and intensity of light and glare reduction, with the entire fixture designed to resist the effects of prolonged environmental exposure. The fixture construction provides simple one screw adjustment of the beam focusing mechanism which also allows for ease of maintenance and resistance to environmental conditions and abuse once the lighting fixture is set into landscaping. The configuration the present invention is aesthetically pleasing with clean lines and is constructed with a focus on simplicity and durability.

Other embodiments and modifications of the present invention may occur to those of ordinary skill in the art in view of these teachings. Therefore, this invention is to be limited only by the following claims which include all other such embodiments and modifications when viewed in conjunction with the above specification and accompanying drawings.

I claim:

1. A lighting fixture with beam spread adjustment, comprising:

a hollow stem having an upper end and a lower end;

a lamp having two conductive prongs extending therefrom;

a base connector disposed within the upper end of the stem, the base connector having an opening therethrough;

a socket disposed within the opening of the base connector, the socket comprising a body portion formed from a non-conductive material and two conductors extending through the body portion, the two conductors adapted to receive the two conductive prongs of the lamp at a first end and to receive two conductive wires at a second end;

a socket housing having an upper portion and a lower portion, the lower portion concentrically mounted on the upper end of the hollow stem to encircle the lamp and socket, wherein the socket housing moves axially relative to the stem for adjusting a combined axial length of the stem and the socket housing, and wherein the lower portion of the socket housing has an elongated slot formed therein;

a cylindrical lens having a lower portion mounted on the upper portion of the socket housing;

a reflector disposed on an upper portion of the cylindrical lens for enclosing the lamp and lamp socket; and a fastener extending radially from the upper end of the stem aligned with the slot in the socket housing, wherein the fastener cooperates with the slot to guide axial movement of the socket housing relative to the stem;

wherein the socket housing, cylindrical lens and reflector move axially relative to the stem, the lamp and the socket to adjust the beam spread over an area to be illuminated.

2. The lighting fixture of claim 1, wherein the slot is disposed at a diagonal relative to a longitudinal axis of the stem, wherein rotation of the socket housing relative to the stem translated to an axial motion so that the socket housing, cylindrical lens and reflector are moved relative to the lamp and the socket.

3. The lighting fixture of claim 1, wherein the reflector is sealed to the upper portion of the cylindrical lens using a watertight sealant.

4. The lighting fixture of claim 3, wherein the watertight sealant is flexible.

5. The lighting fixture of claim 4, wherein the watertight sealant is a silicone-based sealant.

6. The lighting fixture of claim 1, wherein the cylindrical lens comprises a diffuser.

7. The lighting fixture of claim 1, wherein the lamp is a halogen lamp.

8. The lighting fixture of claim 7, wherein the cylindrical lens comprises frosted tempered glass.

9. The lighting fixture of claim 1, wherein the fastener is a screw, and tightening of the screw prevents movement of the socket housing relative to the stem.

10. A lighting fixture with adjustable beam spread, comprising:

a hollow stem;

a lamp;

a lamp socket for retaining the lamp and providing electrical conduction thereto;

a base connector disposed within an upper portion of the hollow stem and having an opening for receiving and retaining the lamp socket;

a pair of conductive wires connected to the lamp socket and extending through the hollow stem;

a fastener extending radially from a side of the lamp socket through the hollow stem and the base connector;

a socket housing having an upper portion with a cylindrical lens extending therefrom to encircle the lamp and a lower portion adapted to slidably and rotatably fit over the upper portion of the hollow stem to enclose the upper portion of the hollow stem, the base connector and the socket, the lower portion of the socket housing having an elongated slot disposed therein so that the slot is aligned with the fastener, wherein the fastener cooperates with the slot to guide movement of the socket housing relative to the upper portion of the hollow stem;

a reflector disposed on an upper portion of the cylindrical lens;

wherein the socket housing, cylindrical lens and reflector move axially relative to the hollow stem, the lamp and the socket to change a distance between the lamp and the reflector whereby the beam spread over an area to be illuminated is adjusted.

11. The lighting fixture of claim 10, wherein the slot is disposed at a diagonal relative to a longitudinal axis of the hollow stem, wherein rotation of the socket housing relative to the stem translates to an axial motion so that the socket housing, cylindrical lens and reflector are moved relative to the lamp and the socket.

12. The lighting fixture of claim 10, wherein the reflector is sealed to the upper portion of the cylindrical lens using a watertight sealant.

13. The lighting fixture of claim 12, wherein the watertight sealant is flexible.

14. The lighting fixture of claim 13, wherein the watertight sealant is a silicone-based sealant.

15. The lighting fixture of claim 10, wherein the cylindrical lens comprises a diffuser.

16. The lighting fixture of claim 15, wherein the cylindrical lens comprises frosted tempered glass.

17. The lighting fixture of claim 10, wherein the lamp is a halogen lamp.

18. The lighting fixture of claim 10, wherein the fastener is a screw, and tightening of the screw prevents movement of the socket housing relative to the stem.

* * * * *